US005099565A

United States Patent [19]

Campbell

[11] Patent Number: 5,099,565

[45] Date of Patent: Mar. 31, 1992

[54] METHOD OF REPAIR OR REPLACEMENT A HYDRANT CASING

[76] Inventor: Marc Campbell, 506 Normandy Street, Unit #2, Oshawa, Ontario, Canada, L1H 7N8

[21] Appl. No.: 535,495

[22] Filed: Jun. 11, 1990

[30] Foreign Application Priority Data

Jun. 13, 1989 [CA] Canada ..... 602644

[51] Int. Cl.[5] ..... B23P 6/00; F16L 55/18

[52] U.S. Cl. ..... 29/402.08; 29/402.14; 29/402.17; 137/15; 137/315

[58] Field of Search ..... 29/402.08, 557, 402.03, 29/402.11, 402.12, 402.14, 402.15, 402.17; 137/15, 294, 295, 296, 315, 316, 272, 283

[56] References Cited

U.S. PATENT DOCUMENTS

| | | | |
|---|---|---|---|
| 1,349,062 | 8/1920 | Goldberg | 137/283 |
| 2,018,455 | 10/1935 | Lofton | 137/272 X |
| 2,282,641 | 5/1942 | Corey | 137/272 X |
| 4,161,958 | 7/1979 | Behle | 137/316 |
| 4,748,997 | 6/1988 | Ragsdale | 29/402.08 X |

FOREIGN PATENT DOCUMENTS 606008 11/1934 Fed. Rep. of Germany ..... 137/272

*Primary Examiner*—Timothy V. Eley
*Assistant Examiner*—Peter Dungba Vo
*Attorney, Agent, or Firm*—Mirek A. Waraksa

[57] ABSTRACT

A damaged hydrant casing which has an integral barrel extending below ground level is repaired without excavation. A support structure defining a horizontal work surface is clamped to the hydrant barrel. A powered groove-forming tool is supported from the work surface with a mechanical spacer and moved about the barrel to form a circumferential groove. A powered cutting tool is then supported from the work surface with another mechanical spacer and moved about the barrel to cut the barrel circumferentially above the groove. An upper defective portion of the hydrant casing is removed and only a stub portion of the barrel remains above ground. A split flange with a frangible inner lip is secured to the stub portion of the barrel with the lip seated in the circumferential groove. Another hydrant casing having a lower complementary flange is then seated on the split flange, and the two flanges are secured to one another with bolts. The support member is then released and removed.

8 Claims, 3 Drawing Sheets

METHOD OF REPAIR OR REPLACEMENT A HYDRANT CASING

FIELD OF THE INVENTION

The invention relates generally to hydrant repair, and more specifically, to repair or conversion of hydrants which have an integral barrel extending below ground.

BACKGROUND OF THE INVENTION

There remain in use today many old-style hydrants which have an integral barrel extending below ground. Newer hydrants are no longer formed in such a manner, but have essentially a two-piece casing construction. An upper casing portion with water outlets and a relatively short barrel is located entirely above ground. A separate lower casing portion extends below ground and is connected to a water service. The upper and lower casing portions have flanges which are bolted together and which permit disconnection of the two principal components above ground level. One flange will commonly be a split flange with a frangible inner lip that seats in a groove formed in the associated casing portion thereby permitting the upper casing portion to break away from the lower casing portion if struck, for example, by a vehicle. The advantage of such newer hydrant construction is that damage is often restricted to the split flange and repairs are relatively simple and inexpensive.

Repair of an old-style hydrant whose water outlets or upper casing has been damaged by a vehicle is considerably more complicated and costly. The practice in municipalities is to break the concrete surrounding such a hydrant and to excavate soil to expose the entirety of the barrel and its junction with the water service. The entirety of the hydrant is then replaced, typically with a modern hydrant have the above-described two-part casing to simplify any future repairs. There is an obvious cost-saving to be achieved if the breaking of concrete and excavation can be eliminated. However, to the knowledge of the inventor, no repair or replacement method has been proposed which avoids such costly measures, prior to the present invention.

BRIEF SUMMARY OF THE INVENTION

In one aspect, the invention provides a method of repairing or replacing an upper hydrant casing which is integrally formed with an elongate integral barrel that extends below ground level. The method involves forming a circumferential groove in the barrel at a first height above general ground level. The barrel is cut circumferentially at a second greater height to remove the upper hydrant casing thereby leaving only a stub portion of the barrel above ground. A split flange is secured to the stub portion of the barrel with an inner lip of the flange seated in the circumferential groove. Another upper hydrant casing having a complementary flange on its lower end is seated on the split flange, and the two flanges are then secured to one another. The replacement upper casing may itself be the old upper casing appropriately machined. The method of the invention avoids any need to break concrete or excavation soil surrounding the hydrant.

In another aspect, the invention provides apparatus for use in implementing the method of the invention. This apparatus may include a support structure having a flat work surface and having an aperture positioned substantially centrally within the work surface and dimensioned to receive the hydrant barrel. Means are provided to secure the support structure to the barrel such that the work surface can oriented substantially horizontal at a selectable height above general ground level. A power tool having a groove forming element may be provided together with a vertical spacing assembly adapted to support the power tool from the work surface such that the groove forming element is positioned at the first predetermined height required by the method. The vertical spacing assembly permits the tool to be displaced about the hydrant with the groove forming element operatively engaged with the hydrant barrel to form the required circumferential groove at the required height. A horizontal spacing assembly may also be provided to limit the depth groove formed in the barrel and ensure that a uniform groove is formed. A power cutting tool having a cutting element may be provided together with another vertical spacing assembly adapted to support the cutting tool from the work surface such that the cutting element is positioned at the second predetermined height required by the method. This vertical spacing assembly permits the cutting tool to be displaced about the hydrant barrel with the cutting element operatively engaged with the hydrant barrel to achieve a very reliable circumferential cut.

Various novel and inventive aspects of the present invention will be apparent from a description below of preferred embodiments of hydrant repair and replacement method and apparatus and will be defined in greater detail in the appended claims.

DESCRIPTION OF THE DRAWINGS

The invention will be better understood with reference to drawings in which.

DESCRIPTION OF PREFERRED EMBODIMENTS

Figures 1, 5:
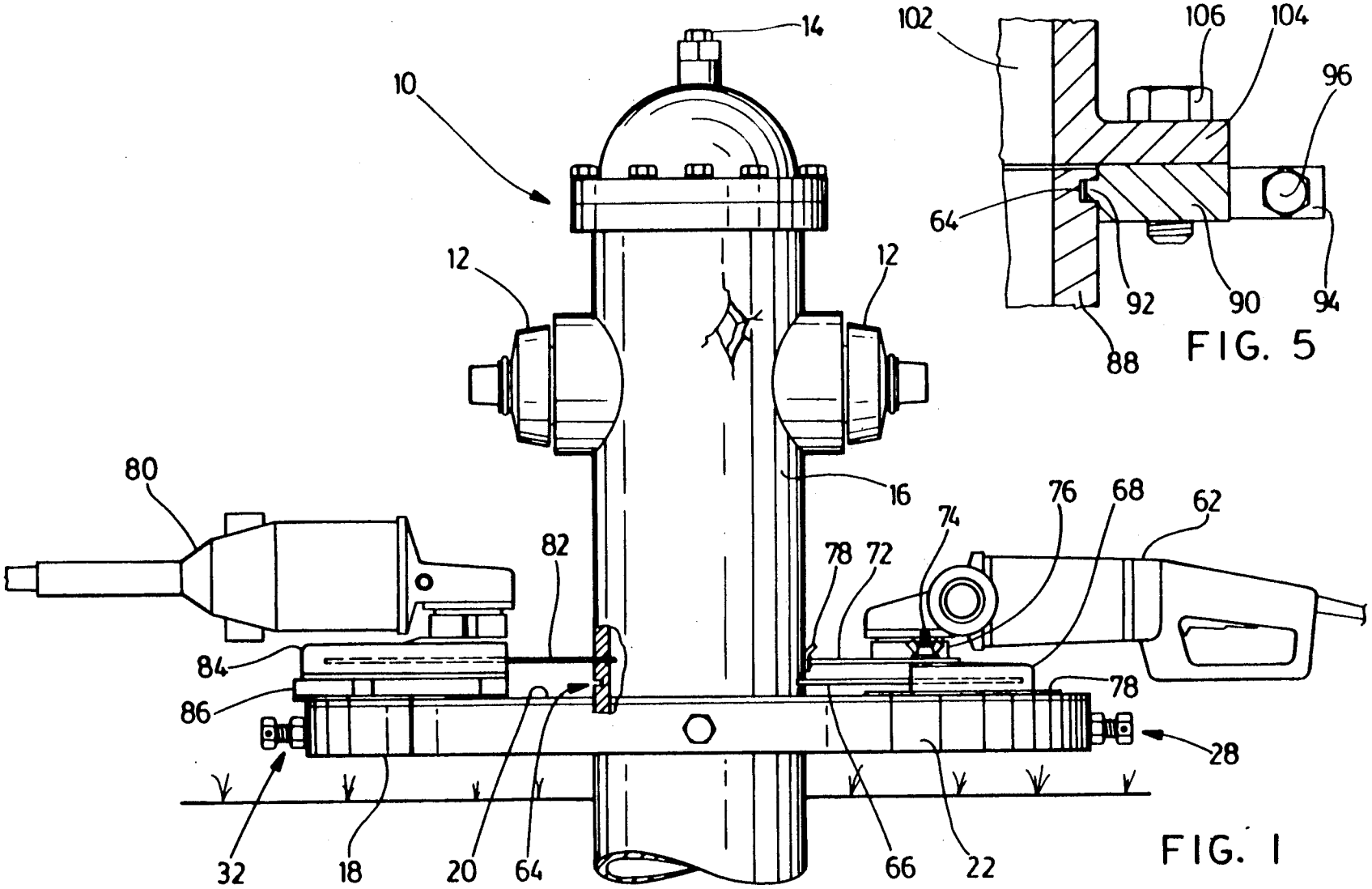
FIG. 1 is an elevational view of a damaged old-style hydrant and repair apparatus embodying the invention.
FIG. 5 is an enlarged fragment view indicating how a split flange and a complementary flange of the repaired hydrant are seated and joined.

Reference is made to FIG. 1 which illustrates an old-style hydrant. The hydrant has a damaged upper casing portion 10 which includes water outlets 12 and appropriate seating for a valve operating nut 14. The upper casing portion 10 is integrally formed with an elongate barrel 16 which extends a considerable distance below ground to a water service (not illustrated). In conventional practice, the soil surrounding the hydrant would be excavated and the entirety of the hydrant down to the water service, removed.

Repair apparatus according to the invention is illustrated in FIG. 1. The apparatus includes a support structure 18 which releasably secures to the hydrant barrel 16 to provide a work surface 20. The support structure 18 comprises concentric inner and outer circular metal sidewalls 21, 22 and an annular arrangement of metal plates 24 fastened to and extending between the concentric sidewalls 21, 22 to define the work surface 20. A large central aperture 26 in the work surface 20 is dimensioned to receive the hydrant barrel 16 and in this embodiment is just sufficient to permit clearing of the opposing water outlets 12 when inserted over the top of the hydrant and appropriately tilted. It will be apparent from FIG. 2 that the support structure 18 is constructed in two-identical halves secured by bolts. If desired, the support structure 18 can be formed in two separable halves with quick release fasteners to avoid insertion over the top of the hydrant.

The support structure 18 can be releasably secured to a hydrant barrel 16 by means of four clamping mechanisms 28, 30, 32, 34. These clamping mechanisms 28, 30, 32, 34 are located in an unobtrusive fashion below the work surface 20 of the support structure 18 and are equally spaced circumferentially about the central aperture 26. Each has a line of action which is directed substantially radially towards the centre of the aperture 26.

Figure 2:
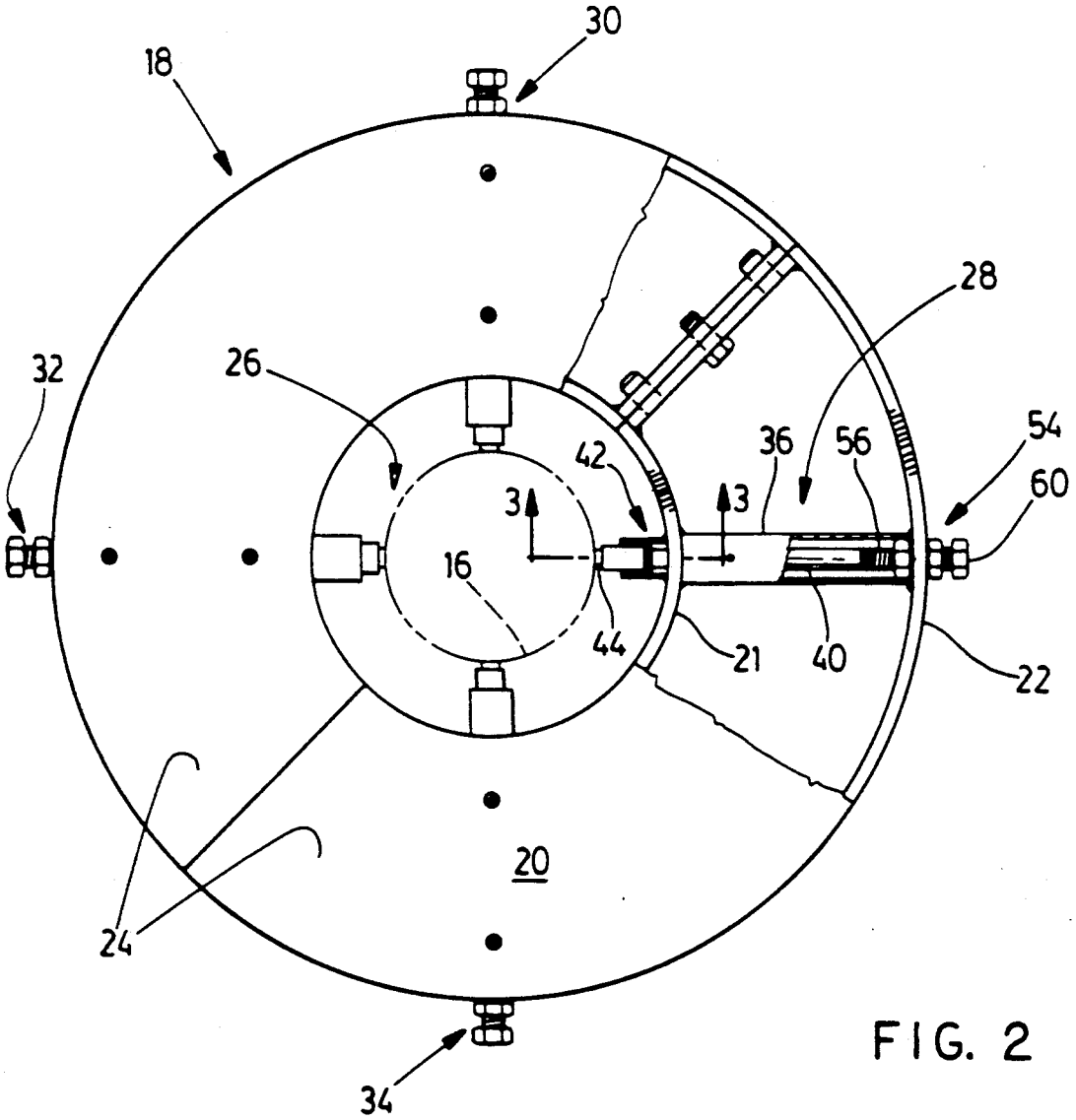
FIG. 2 is a fragmented plan view of a novel support structure associated with the repair apparatus and releasably secured to the hydrant.
Figure 3:
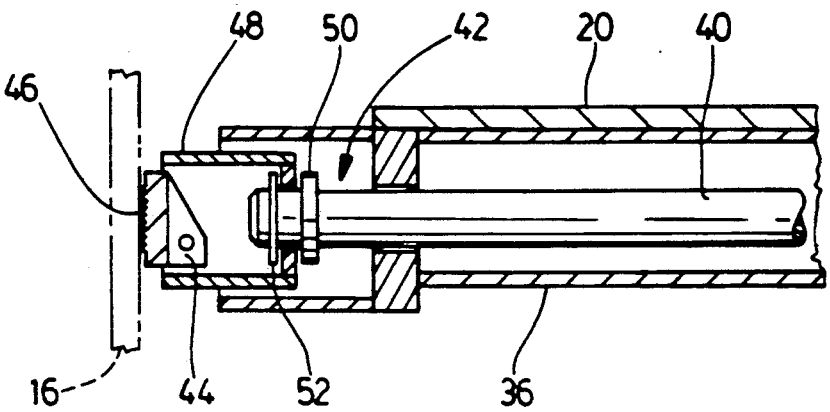
FIG. 3 is a view along lines 3—3 of FIG. 2 detailing a clamping mechanism associated with the support structure.

The clamping mechanism 28 shown fragmented in FIGS. 2 and 3 is typical. The mechanism 28 comprises a tubular support housing 36 which is welded between the inner and outer concentric sidewalls 21, 22 of the support structure 18. A rod-like drive member 40 is located within the support housing 36 and has its longitudinal axis aligned with a radius of the central aperture 26. A radially inner end portion 42 of the drive member 40 supports a clamping member 44 which has a rachet-like surface 46 facing towards the centre of the aperture 26. As apparent in FIG. 3, the clamping member 44 is pivotally mounted within a rectangular housing 48, the housing 48 permitting limited pivoting of the clamping member 44 about a horizontal axis. An apertured end wall of the housing 48 is retained on the drive member 40 between a shoulder 50 fixed to the drive member 40 and a C-clip 52 that seats in a circular groove (not illustrated) formed in the drive member 40. An opposing radially outer end portion 54 of the drive member 40 is formed with an external screw thread 56. This screw thread 56 is meshed with the internal screw thread of a nut 58 welded to the support housing 36. A head 60 at the radially outermost end of the drive member 40 can be rotated with a wrench to displace the drive member 40 axially. The clamping member 44 can consequently be displaced towards and away from the central aperture 26 to engage or disengage from the hydrant barrel 16 positioned within the aperture 26. It will be apparent that the four clamping mechanisms 28, 30, 32, 34 can be adjusted to orient the work surface 20 in a substantially horizontal orientation and permit the height of the work surface 20 relative to general ground level to be readily adjusted.

Once the support structure 18 is secured to the hydrant barrel 16, substantially as illustrated in FIG. 1, an electrically operable grinder 62 can be used to form a circumferential groove 64 in the barrel 16. The grinder 62 is largely conventional and has a rotary blade 66 surrounded by a conventional half-circular guard 68. However, a plate 70 is attached to the guard 68 and serves to space the rotary blade 66 at a predetermined height above the work surface 20. The grinder 62 is simply displaced circumferentially about the hydrant barrel 16 while supported by the spacing plate 70 to form the circumferential groove 64. To ensure that the groove 64 has a uniform depth, a horizontal spacing assembly is provided to engage the barrel 16 during groove forming. This is a very simple mechanism comprising a flat arm 72 with a longitudinal slot (not illustrated). A rear end portion of the arm 72 is fixed to the guard 68 by a bolt 74 extending through the guard 68 and the slot in the arm 72 and fastened with a wing nut 76. The forward end portion has welded thereto a plate 78 intended to engage the hydrant barrel 16 and having an upper part which is bent rearwardly at an angle. In this embodiment, the forward end portion of the arm 72 is maintained radially inset from the outer periphery of the rotary blade 66, and consequently permits the rotary blade 66 to penetrate the barrel 16 to only a predetermined distance (apparent in the plane of FIG. 1) as the grinder 62 is displaced around the hydrant barrel 16.

The repair apparatus also includes an electrically-powered cutting tool 80 with a conventional rotary cutting blade 82 and half-circular guard 84 surrounding a portion of the blade 82. A spacing assembly 86 (consisting of upper and lower metal plates separated by spacers) is attached to the guard 84 and serves to set the height of the cutting blade 82 relative to the work surface 20. The height of the spacing assembly 86 is so selected that the barrel 16 is cut at a height relative to the work surface 20 which is greater than the height at which the circumferential groove 64 was formed. The lower surface of the spacing assembly 86 smoothly engages the horizontal work surface 20 to permit easy sliding displacement of the cutting tool 80. The general shape is such that there is no interference with the cutting action. A circumferential cut can be formed at uniform height in the barrel 16 by simply engaging the cutting blade 82 with the barrel 16 while the cutting tool 80 is supported by the spacing assembly 86 and sliding the tool 80 and spacing assembly 86 on the work surface 20 circumferentially about the hydrant barrel 16.

Figure 4:
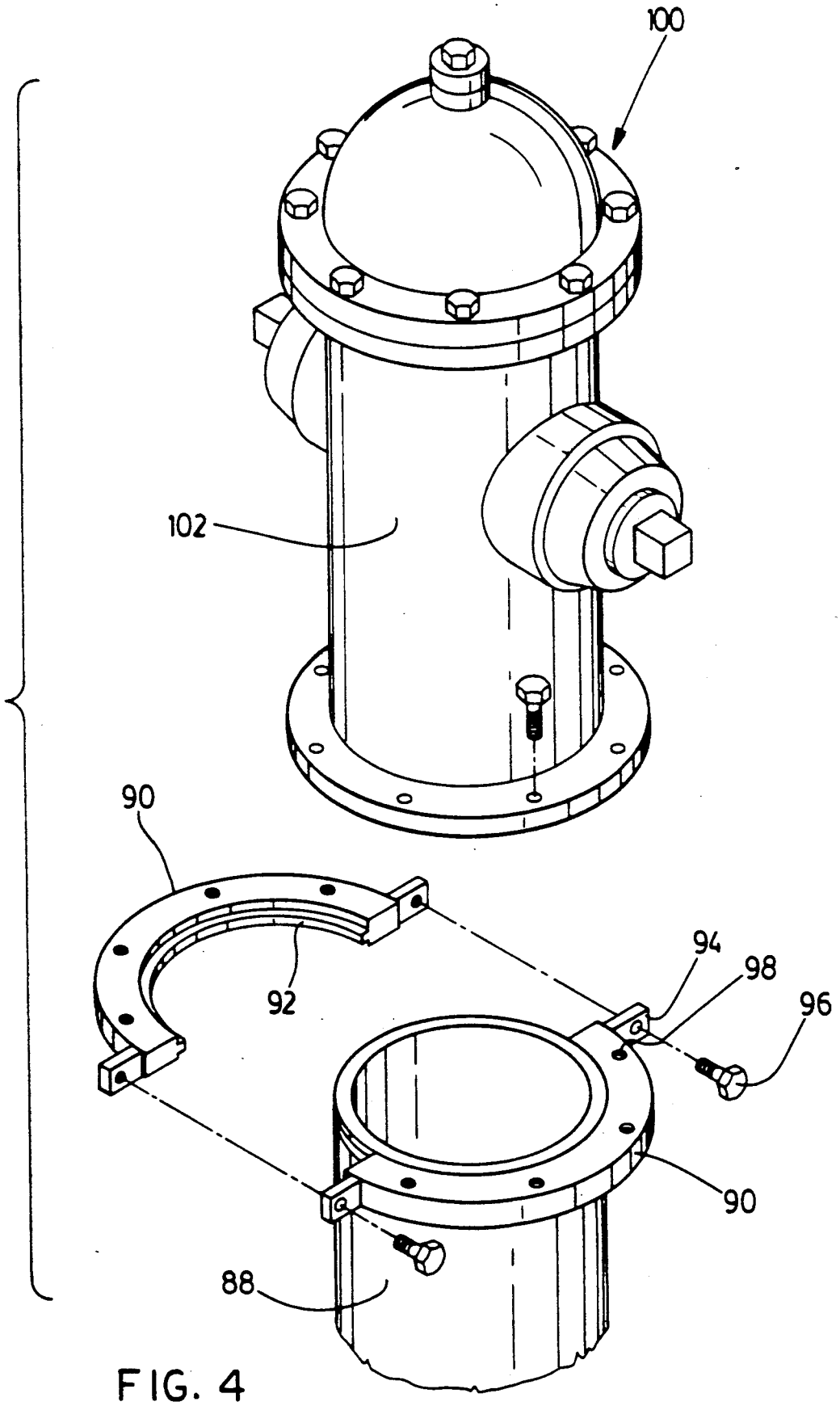
FIG. 4 is an exploded perspective view of the repaired hydrant.

When the grooving and cutting operations are complete, the damaged upper hydrant casing portion 10 is removed and only a stub portion 88 of the barrel 16 remains above ground (as apparent in FIG. 4.) A split annular flange 90 is then secured about the barrel 16 with an inner frangible circumferential lip 92 of the flange seated in the circumferential groove 64. The two halves of the split flange 90 are formed with radially-directed apertured lugs (such as the lug 94) which align to receive bolts (such as the bolt 96) for securing of the flange to the hydrant. Threaded vertical apertures (such as the aperture 98) are regularly spaced circumferentially about the flange (only one such aperture being specifically indicated). A new upper hydrant casing 100 having a relatively short barrel 102 whose lower end is terminated with a complementary flange 104 is then seated on the split flange 90. The two flanges 90, 104 are then secured to one another by extending bolts (such as the bolt 106) vertically through aligned flange apertures and threading the bolts into the threaded apertures of the split flange 90. This is apparent in FIG. 5.

In connection with repair of the upper casing portion 10, it may be desirable to replace the entirety of the elongate valve operating mechanism which couples the valve nut 14 with the valve normally located at the junction of the water service and the base of the hydrant. This can be done in a conventional manner from the surface, and may involve replacement with a break-away mechanism appropriate for a break-away hydrant. Alternatively the existing operating mechanism can be removed, divided into two parts, and joined with a break-away joint.

The apparatus of the invention provides a particularly advantageous means of implementing the general method of the invention. The support structure 18 provides a horizontal work surface 20 which serves as a frame of reference for formation of the required circumferential groove and circumferential cut. The mechanical spacing assemblies associated with the cutting and groove-forming tools automatically orient the grinding and cutting blades at the different heights required for such purposes. The relative heights will be dictated by the dimensions of the type of flange which will generally be used in performing such repairs, the object being to ensure that the upper flange surface is ultimately flush with or marginally higher than the top of the stub portion of the barrel. Accordingly, the required groove and cut can be formed in a very predictable manner even by relatively unskilled workmen. The overall advantage of the method, of course, is that no breaking of concrete or excavation is required, and what is otherwise a rather costly and long repair operation can be performed in just a few hours at considerably lower costs.

It will be appreciated that particular embodiments of the invention have been described and that modifications may be made therein without departing from the spirit of the invention or necessarily departing from the scope of the appended claims. It should be noted that various repair or replacement steps can be performed in different order. In particular, although it is preferred to form a circumferential groove first and then to cut a hydrant barrel circumferentially at a greater height, the order in which the grooves and cuts are formed is not a critical aspect of the invention. Lastly, it is fully contemplated that the methods of the invention may be used prior to actual damage to an old-style hydrant to replace an upper upper hydrant portion with a view to limiting any future damage to the hydrant to breaking of the split flange.

I claim:

1. A method of replacing an upper hydrant casing portion which is integrally formed with an elongate integral barrel that extends below ground level, comprising:

forming a circumferential groove in the barrel at a first height above general ground level;

cutting the barrel circumferentially at a second greater height above general ground level to remove the upper hydrant casing portion thereby leaving only a stub portion of the barrel above ground;

seating a split flange with an inner lip about the stub portion of the barrel with the lip located in the circumferential groove and securing the split flange to the barrel;

seating another upper hydrant casing portion having a complementary flange on its lower end on the stub portion of the barrel with the complementary flange seated on the split flange;

securing the split flange and the complementary flange to one another.

2. The method of claim 1 further comprising the step of securing means defining a horizontal work surface to the barrel of the hydrant casing portion with the horizontal work surface positioned between general ground level and the first height above general ground level, prior to forming the circumferential groove and cutting the barrel circumferentially.

3. The method of claim 2 in which the step of cutting the hydrant barrel comprises:

positioning a cutting element of a powered cutting tool at the second height above general ground level by supporting the powered cutting tool from the work surface with mechanical spacing means; and, displacing the powered cutting tool about the hydrant barrel while spaced from the work surface by the mechanical spacing means thereby circumferentially cutting the barrel with the cutting element.

4. The method of claim 2 in which the step of forming the circumferential groove comprises:

positioning a groove forming element of a power tool at the first height above ground by supporting the power tool from the work surface with mechanical spacing means;

displacing the power tool about the hydrant barrel while supported from the work surface by the mechanical spacing means thereby forming the circumferential groove with the groove forming element.

5. The method of claim 4 in which the displacing of the power tool comprises engaging mechanical spacing means between the hydrant barrel and the power tool thereby forming the circumferential groove to a substantially uniform depth around the barrel.

6. The method of claim 5 in which the step of cutting the hydrant barrel comprises:

positioning a cutting element of a powered cutting tool at the second height above ground by supporting the powered cutting tool from the work surface with mechanical spacing means; and, displacing the powered cutting tool about the hydrant barrel while spaced from the work surface by the mechanical spacing means thereby circumferentially cutting the barrel with the cutting element.

7. A method of replacing an upper hydrant casing portion which is integrally formed with an elongate integral barrel that extends below general ground level, comprising:

releasably securing to the barrel means defining a horizontal work surface;

locating a power tool with a groove forming element on the horizontal surface;

supporting the power tool from the work surface with mechanical spacing means such that the groove forming element acts on the barrel at a first predetermined height above the work surface;

displacing the power tool while supported by its mechanical spacing means about the barrel to form a circumferential groove;

locating a powered cutting tool with a cutting element on the horizontal surface;

supporting the powered cutting tool from the work surface with mechanical spacing means such that the cutting element acts on the barrel at a second predetermined height above the work surface greater than the first predetermined height;

displacing the powered cutting tool while supported by its mechanical spacing means about the barrel to cut the barrel circumferentially and removing the upper hydrant casing portion thereby leaving only a stub portion of the barrel above ground;

removing the means defining the horizontal work surface from the hydrant barrel after the circumferential groove is formed and the hydrant barrel is cut circumferentially;

seating a split flange with a inner lip about the stub portion of the barrel with the inner lip in the annular groove and securing the split flange to the barrel;

seating another hydrant casing portion having a complementary flange on its lower end on the stub portion of the barrel with the complementary flange seated on the split flange;

securing the split flange and the complementary flange to one another.

8. The method of claim 7 in which the displacing of the power tool comprises engaging mechanical spacing means between the hydrant barrel and the power tool thereby forming the circumferential groove to a substantially uniform depth around the barrel.

* * * * *